US012179080B2

(12) United States Patent
Pappas

(10) Patent No.: US 12,179,080 B2
(45) Date of Patent: Dec. 31, 2024

(54) TRAINING DEVICE FOR A GAME OF HOCKEY

(71) Applicant: Derek Pappas, San Mateo, CA (US)

(72) Inventor: Derek Pappas, San Mateo, CA (US)

( * ) Notice: Subject to any disclaimer, the term of this patent is extended or adjusted under 35 U.S.C. 154(b) by 173 days.

(21) Appl. No.: 17/711,496

(22) Filed: Apr. 1, 2022

(65) Prior Publication Data

US 2023/0310962 A1 Oct. 5, 2023

(51) Int. Cl.
*A63B 69/00* (2006.01)
*A63B 59/70* (2015.01)

(52) U.S. Cl.
CPC ..... *A63B 69/0024* (2013.01); *A63B 59/70* (2015.10); *A63B 2214/00* (2020.08); *A63B 2220/40* (2013.01); *A63B 2220/833* (2013.01)

(58) Field of Classification Search
CPC . A63B 69/0024; A63B 59/70; A63B 2220/40; A63B 2214/00; A63B 2220/833
USPC ..... 473/446
See application file for complete search history.

(56) References Cited

U.S. PATENT DOCUMENTS

| | | | | |
|---|---|---|---|---|
| 5,121,925 | A * | 6/1992 | Blundo | A63B 15/00 473/256 |
| 5,174,567 | A * | 12/1992 | Nordstrom | A63B 69/0024 473/256 |
| 6,645,084 | B1 * | 11/2003 | Dayton | A63B 57/00 473/228 |
| 9,925,433 | B2 * | 3/2018 | Boggs | A63B 71/0619 |
| 11,517,801 | B2 * | 12/2022 | Plizga | A63B 60/60 |
| 11,577,142 | B2 * | 2/2023 | Howenstein | G06V 40/23 |
| 2004/0259651 | A1 * | 12/2004 | Storek | G01P 15/00 473/131 |
| 2011/0201459 | A1 * | 8/2011 | Lundeen | A63B 69/0026 473/446 |
| 2023/0310962 | A1 * | 10/2023 | Pappas | A63B 69/0024 473/446 |

* cited by examiner

*Primary Examiner* — Mitra Aryanpour

(57) ABSTRACT

A training device for a game of stick and ball, such as filed hockey. The training device can mount to a standard hockey stick to guide the movements and limit certain movements and spatial positions of the hockey stick while practicing. The training device includes a disc having a central section and a peripheral rim; a sleeve in the central section receives a handle and a shaft of a stick; and a fastening member coupled to the sleeve and secures the training device to a head or the shaft of the stick that is within the sleeve.

14 Claims, 3 Drawing Sheets

TRAINING DEVICE FOR A GAME OF HOCKEY

FIELD OF INVENTION

The present invention relates to a training device for sports, and more particularly, the present invention relates to a training device for a game of hockey.

BACKGROUND

Field hockey is one of the oldest and most popular outdoor games played in teams. Also, called hockey, the term field hockey (hockey) is generally used to distinguish it from ice hockey. Hockey is a game that requires that players learn highly technical skills. In hockey, a small hard ball is maneuvered with a hockey stick. Maneuvering the ball is generally referred to as stick work or dribbling. Some of the basic skills desired in field hockey are dribbling (moving the ball), trapping (receiving the ball), passing, and tackling. Field hockey players use stick work to move the ball in the desired direction including left, right, forwards, backward, and diagonally. The stick work is used to maneuver the ball when running and position the ball for passing and shooting. It is difficult to learn to maneuver the ball with a stick. Current methods used for learning the stick work include learning the correct grip, stick motion when dragging or popping the ball, and rotating the stick over the ball to change the direction of the ball through instruction by coaches and practice by players. Becoming an advanced dribbler of the ball can take many years of practice and gameplay. One measure of a player's ability to dribble the ball can be measured by the number of times they can drag the ball over one meter in one minute. At each extreme of the drag left to right and right to left, the stick must be rotated quickly and efficiently over the ball. The most efficient method for rotating the stick over the ball is to have the stick in contact with the ball during the rotation over the top of the ball.

The stick work is used to move the ball with the stick's toe. The left hand rotates the stick from a toe's up position (the forehand or front stick side) to a toe's down position (the reverse stick position). When the stick is in the front stick position, the ball should be centered on the straight part of the stick. When the stick is in the reverse stick position, the ball should be on the end of the toe. During the rotation over the ball from the front stick to the reverse stick position, the stick moves its relative position from the straight part of the stick to the toe. During the rotation over the ball from the reverse stick to the front stick position, the stick moves its relative position from the end of the toe to the straight part of the stick. The right hand is used to move the stick and hence the ball back and forth in front of the player's feet or forwards and backward along the right side of the player or diagonally or in a curve from right to left (the drag). When the ball is being dragged back and forth, at the left and right extremes of the ball movement, the stick will rotate over the ball so that the stick can then move the ball in the opposite direction or stop the ball.

Dribbling has several different axes of movement that the stick moves through when the player is dribbling the ball. The two primary movements of the stick used to propel the ball along the ground and to change the direction of the ball are the movement of the ball sideways or forwards and backward, to the turning over of the stick. There are desired or more efficient movements of the stick that gives the player greater control over the ball and allow the player to move the ball more quickly than less efficient movements of the stick. The first important movement is the rotation of the stick relative to the end of the stick handle. The desired movement is rotating the stick relative to the end of the stick and not to some point below the end of the handle where the left hand or the right hand is holding onto the stick. A line from the center of the end of the handle to the center of the ball is the center of the rotation of the stick around the ball. Players make a mistake by moving the left hand, left and right when rotating the stick. There are many reasons why the stick should be rotated around the end of the center of the handle. If the left hand does not move and the stick is rotated around the end of the center of the end of the handle, then the stick face will move around the ball in the correct position on the ball. In order to develop advanced dribbling skills, the player must learn to roll the right hand down slightly when rotating the stick from the reverse to the front stick position.

The second important movement of the stick is the movement of the end of the stick along a line from left to right and right to left relative to the shoulders or forwards and backward on the right side. The end of the handle is the pivot point for the movement from left to right and from right to left. The stick moves like a clock hand from left to right and from right to left. The movement of the stick along with a line relative to the shoulders is important. While dragging the ball from left to right and from right to left, in most instances it is especially important to maintain the position of the stick face on the same relative position on the ball. The movement of the hands and the stick in a direction not in line with the shoulders is sometimes done in advanced dribbling. When running with the ball and dribbling the ball from left to right or right to left, which is the most common instance of dribbling, it is important to keep the same distance of the hands from the body to maintain the same relative position of the sick face on the ball.

The third important movement of the stick is the turning of the stick over the ball at the extreme left or right movement of the ball with the stick's toe up or down respectively. Learning how to roll the stick over the ball without changing the height of the end of the stick handle and without changing the relative position of the hands relative to the shoulders and the relative position of the hands relative to the ground is difficult and takes many years. Introducing controls over the end of the stick movement with a training device can drastically reduce the amount of time it takes to learn the rotational movement and can be used to refine advanced dribbling skills.

The fourth important movement of the stick is the extension of the stick past the ball when the ball is being dragged to the left. The extension of the stick past the ball prevents the ball from running off the end of the stick. Learning to use the end of the stick as the pivot point and positioning the ball on the straight part of the stick and not the curved part of the stick is key to preventing the ball from running off the end of the stick.

The fifth movement of the stick is the movement of the middle of the handle forwards and backward. This is a more advanced movement that is usually used to move the ball forward and backward in a more upright position. The Sixth movement of the stick is the movement of the right hand slightly up and down during the rotation of the stick over the ball. When the stick rotates over the ball, the stick should move up slightly over the ball. The center of the end of the stick should not change its relative position very much. There are other advanced movements of the stick derived from the basic dribbling movements.

The different dribbling movements are difficult to learn and master. A player starts by learning the basic skills under a supervision of a coach. Learning how to dribble a hockey ball requires that the player does not introduce incorrect movements of the hands or legs or body during the dribbling motion. Any introduction of incorrect movements of the hands or legs or body during the dribbling motion results in exaggerated movements of the stick and undesirable changes of the relative position of the stick face to the ball. The primary mission of the dribbler is to maintain the correct relative position of the face of the stick on the ball, the correct direction of the stick, and the correct motion of the face of the stick. Mistakes include sliding the stick across the face of the ball which results in the stick face traveling on a different line than the line that the ball is traveling results in the ball running off of the end of the stick and the loss of control over the ball. Learning or mastering the skills to control the ball with the hockey stick is difficult and takes a lot of time and practice. Multiple factors are involved in the use of the hockey stick to control the ball including the position and angle of the hockey stick and the motion of the hockey stick along the ground and over the ball. The movement of the stick is controlled by the grip used, the movements of the right and left hands and arms, and the body posture.

Thus, supervised learning in the presence of a coach is important to learn correct techniques and avoid practicing the wrong techniques. However, the supervision of the coach may not always be available. Moreover, in the presence of a coach, the coach cannot devote all the time to a single player. It takes hundreds, if not thousands of hours, to become an advanced dribbler. Therefore, a training device is needed that controls the motion of the stick over the ball and maintains the angle of the stick relative to the ground to assist a player in learning and training their muscle memory, by practicing the correct technique of dribbling a hockey ball.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a training device and a method for learning and mastering dribbling skills in a game of hockey by practicing.

It is another object of the present invention to allow a player to improvise their dribbling skills without the supervision of a coach.

It is still another object of the present invention that the training device helps a player to learn a correct technique.

It is yet another object of the present invention that the training device can be used with a standard hockey stick.

It is a further object of the present invention that the training device can be economical to manufacture.

In one aspect, disclosed is a training device and a method for improvising the dribbling skills in the game of hockey. The training device includes a disc of a shape ranging from round to oval. The training device is configured to be mounted to a standard hockey stick. The disc can include a central section and a peripheral rim around the central section. The central section can include a sleeve configured to receive a handle and a shaft of the hockey stick. The sleeve further includes a fastening member configured to secure the training device to a head or the shaft of the hockey stick, wherein the disc extends radially in a direction perpendicular to the length of the shaft. The exact position of the training device on the hockey stick may depend on the dribbling movement being practiced and can be determined by suitable experimentation and minor adjustments can be made as desired by the trainee.

In one aspect, the shape and dimensions of the central section can be varied, for example, the central section can be planar, or consists of a series of spokes extending from the sleeve to the peripheral rim, or the central section can be solid with multiple cutouts, or can resemble a shape of an airfoil i.e., curved near the peripheral rim.

In one aspect, the sleeve can be at the center of the central section. Alternatively, the sleeve can be off-center.

In one aspect, the peripheral rim can have a smooth surface.

In one aspect, the periphery rim can be integral with the central section to form a single unit.

In one aspect the peripheral rim and the central section can be integral, and the central section can be attached to the sleeve.

In one aspect, the training device can further include sensors, such as a gyroscope and accelerometer to detect tilt, rotation, and movement of the training device. The sensor can transmit timing and position information to a cell phone or computer for analysis and competition.

In one aspect, disclosed is a method of training dribbling technique in the game of hockey. The training device can guide the path of a hockey stick in two or more axis of motion during a dribble in order to keep the stick face and toe on the ground and on the ball during the left to right and right to left motion and keep the stick on the ball during the rotation over the ball in order to position the stick face and toe on the ball in the optimal position for the given stick and ball position and to maintain control over the ball.

In one aspect, the disclosed training device can guide the end of a hockey stick during a dribble in order to keep the end of the handle in the same position during the left to right and right to left motion and keep the stick on the ball during the rotation over the ball.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
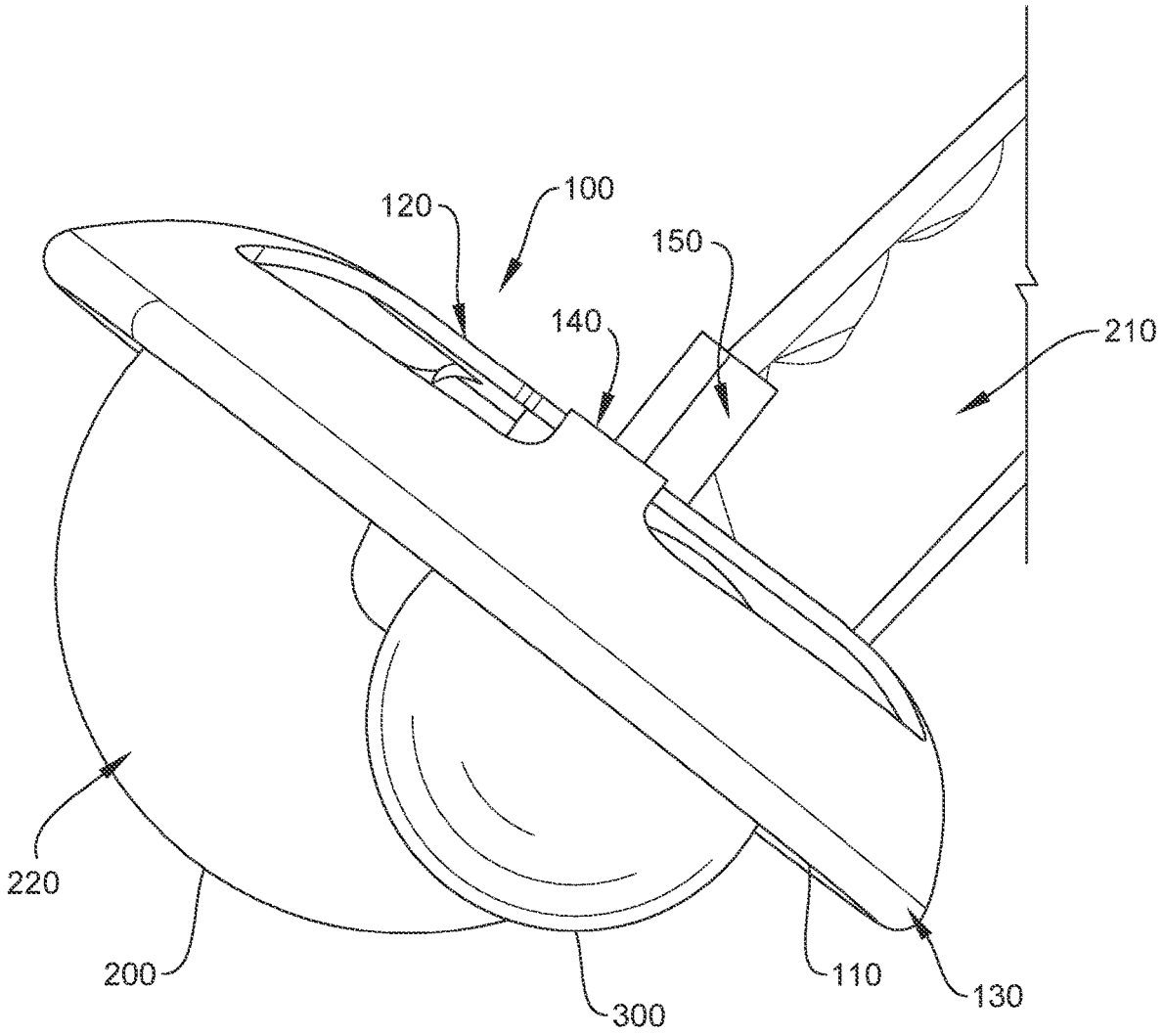
FIG. 1 is a perspective view of the training device, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Disclosed is a training device, also referred to herein as a training device, for learning and mastering the dribbling technique by practicing in a game of stick and ball, such as field hockey that involves repetitive motions used to control a ball with a sports instrument that has a handle and an end designed to control the ball. The disclosed training device can be used to learn different techniques in addition to the dribbling technique without departing from the scope of the present invention. The following embodiments will be described taking field hockey as an example, however, the scope of the following embodiments should not be limited to the game of field hockey.

In certain embodiments, the training device can stabilize the hockey stick, resulting in a gain of control over the ball while practicing so that the trainee can pay attention to different aspects of the technique and can learn the correct technique by repeatedly practicing the different dribbling movements. The disclosed training device can help the trainee with proper hand positioning and gripping of the hockey stick which may otherwise go unnoticed and the trainee learning incorrect handling. This is the primary reason behind the trainee not learning or practicing the most important movement in dribbling i.e., the rotation of the stick relative to the end of the stick handle. Not controlling the rotation point of the end of the handle can lead to learning the wrong technique. The disclosed training device can help a trainee maintain the correct rotational point.

Referring to FIG. 1 which shows an exemplary embodiment of the training device 100 shown mounted to a hockey stick 200. The training device 100 can include a disc 110, and the disc 110 can include a central section 120 and a peripheral rim 130. The central section 120 can include a sleeve 140 that can be positioned off-center in the central section 120. The sleeve 140 can receive the handle and the shaft of a standard hockey stick. The hockey stick through the handle can be inserted into the sleeve till the training device 100 is at a predetermined position on the shaft of the hockey stick. Once at the predetermined position, the training device can be secured to the stick. The training device can further include a fastening member 150 that clamps to the shaft of the hockey stick for fixedly mounting the training device to the hockey stick. FIG. 1 shows the hockey stick 200 having a shaft 210 and a toe 220. The toe 220 herein refers to both the heel and toe of a standard hockey stick. The toe 220 can be in an up position or a down position, FIG. 1 shows the toe 220 in the up-position. The portion between the toe 220 and the shaft 210 can be called the head of the hockey stick, and the training device 100 can be mounted near the toe 220 at the head or the shaft 210 of the stick 200. It is understood that the head and the shaft are just used to describe portions of the hockey stick, adjacent to the toe, and the training device can be positioned just above the toe and the exact position of the training device above the toe can vary depending on the intended use and the trainee. The central section of the disc can radially extend from the sleeve. It is understood FIG. 1 illustrates an exemplary embodiment, however, the disc can be of any other shape and may not have to be a disc. Also, the central section can be solid or spoke.

The training device 100 including the disc, the sleeve, and the fastening member can be made from any rigid and lightweight material that does not undesirably increase the weight of the stick. For example, the training device can be made from plastic material or lightweight metal. The peripheral rim 130 of the disc 110 can be smooth or rubberized. The smooth surface of the peripheral rim can slide over a surface smoothly offering less friction. The rubberized surface on the other hand may offer more resistance against the sliding motion but can roll on the surface. The central section can be of a shape ranging from round to oval. The central section can be of a shape from planar to an airfoil shape, as shown in FIG. 1. The central section can be made from spokes extending from a sleeve radially. Alternatively, a continuous disc or a continuous disc with cutouts can be provided. Spokes or cutouts can help make the training device lighter.

The central section and the peripheral rim can be separate or integral. When separate, the peripheral rim can be mounted to the central section. When the peripheral rim and the central section are integral, the central section can be integral or separate from the sleeve. When integral, the peripheral rim, the central section, and the sleeve can be integral to form a single unit.

Figure 2:
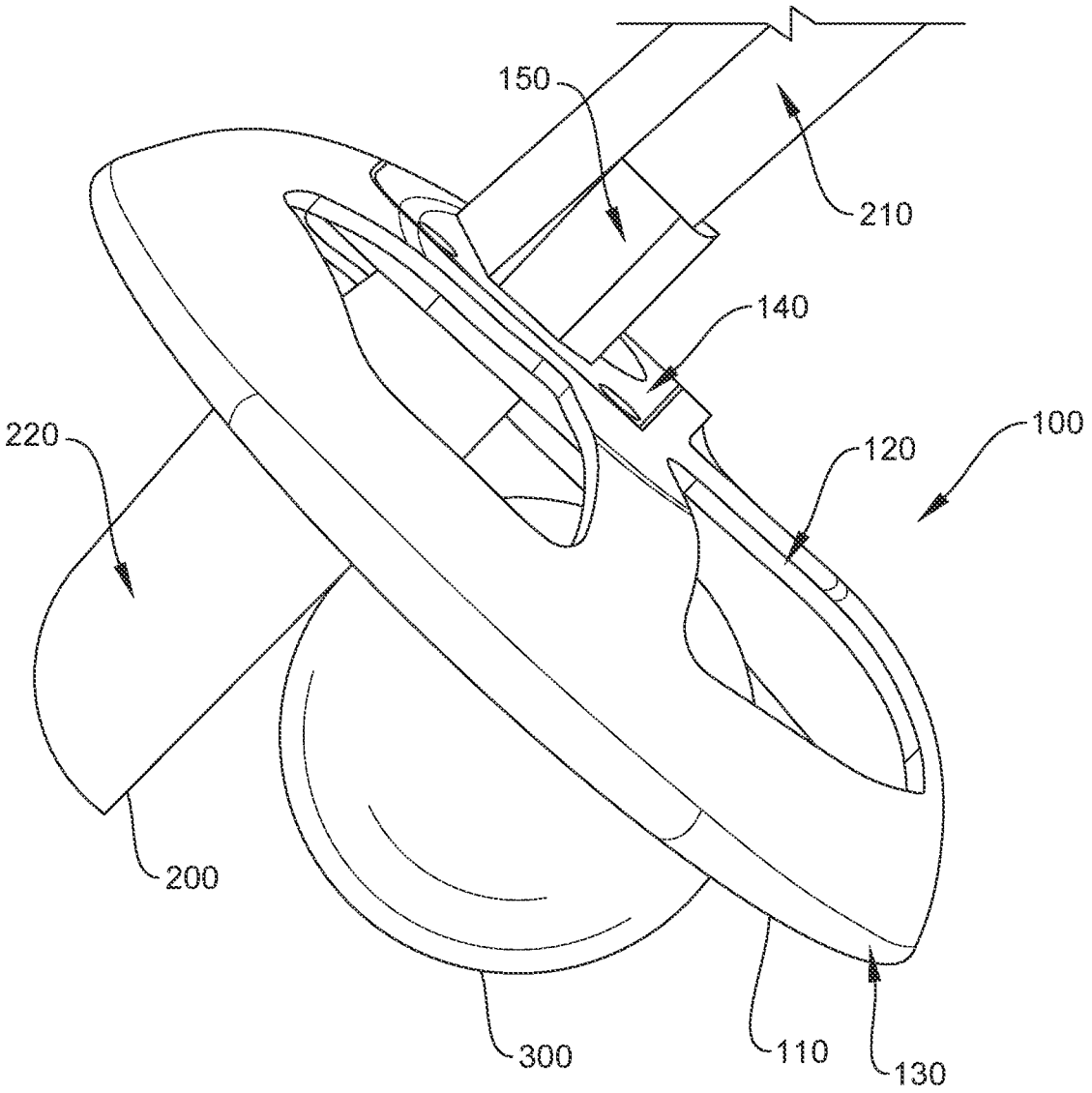
FIG. 2 shows another view of the training device, according to an exemplary embodiment of the present invention.

Also, it can be seen in FIG. 1 that sleeve 140 is positioned away from the center of the central section. The offset positioning of the sleeve in the central section and thus the stick to which the training device is mounted can be important for clearing the correct dribbling techniques. As shown in FIG. 2, the toe of the stick can be turned over the ball 300 while remaining in touch with the ball, and the peripheral rim of the training device remains in touch with the ground. FIG. 2 shows the toe of the stick above the ball. The user without loosening the hands can turn the stick which turns the training device, and the toe of the stick can turn over the ball to the opposite side of the ball. FIG. 2 shows the toe of the stick over the ball and the rotation of the toe can be continued till the toe lands on the opposite side of the ball. Then the ball can be again carried by the stick up to the desired distance, and upon reaching the desired distance, the stick can again be turned over the ball to land on the opposite side of the ball. These steps can be repeated as many times as desired for practice wherein the ball is dragged back and forth within the desired distance by the stick. The training device while rotating the stick over the ball can keep the ball in control and maintain the stick and the holding of the stick including rotation within the correct position. Repeated practice can help the trainee to memorize the technique.

While dragging the ball with the face of the hockey's toe, the toe either in up or down position should touch the ground, and also the peripheral rim of the training device should be touching the ground, as shown in FIG. 1, positioning the handle of the stick at the desired angle from a reference horizontal plane. This angle can be adjusted by moving the training device up and down the head or shaft of the stick within a certain range. The ball can be dragged by the stick while both the toe and the training device can remain in contact with the ground and thus the handle of the hockey can remain at the desired angle during dribbling. The training device allows the stick to be rotated relative to the end of the handle and the stick face can remain at the same relative position on the ball unless the stick is moved forward or backward along the stick axis. Moreover, while moving the ball left or right, the movement of the stick can remain along with a line relative to the shoulders. Thus, when dribbling the ball from left to right or right to left, which is the most common instance of dribbling, the distance of the hands from the body can remain the same in order to maintain the same relative position of the stick face on the ball. Also, as can be seen in FIG. 2, that the stick can be turned over the ball guided by the training device and without changing the height of the end of the stick handle and without changing the relative position of the hands relative to the shoulders (90 degrees to the shoulders—the right-hand moves the stick across the shoulders when moving the ball left to right and right to left) and the position of the hands relative to the ground. Also, because of the guided movement provided by the training device, the stick rotates over the ball, and the toe can move up without changing the relative positions of the handle and the shoulders, all of which are the desirable correct techniques of dribbling.

Moreover, while dribbling, the user can focus on the rotation of the end of the handle and keeping the toe on the ball, while the angle of the stick can be controlled by the training device. This makes the complex learning task of dribbling easier for the trainee and the trainee can learn the correct technique and perform the movements with or without the supervision of the coach. In one implementation, the distance of the stick to the ground is determined by the distance that the stick has to be from the ground to be in the correct relative position on the ball at each point during the rotation over the ball, such that the toe of the stick can turn over the ball. The angle of the stick relative to a horizontal plane can be proportional to the position of the training device on the shaft of the stick.

Figure 3:
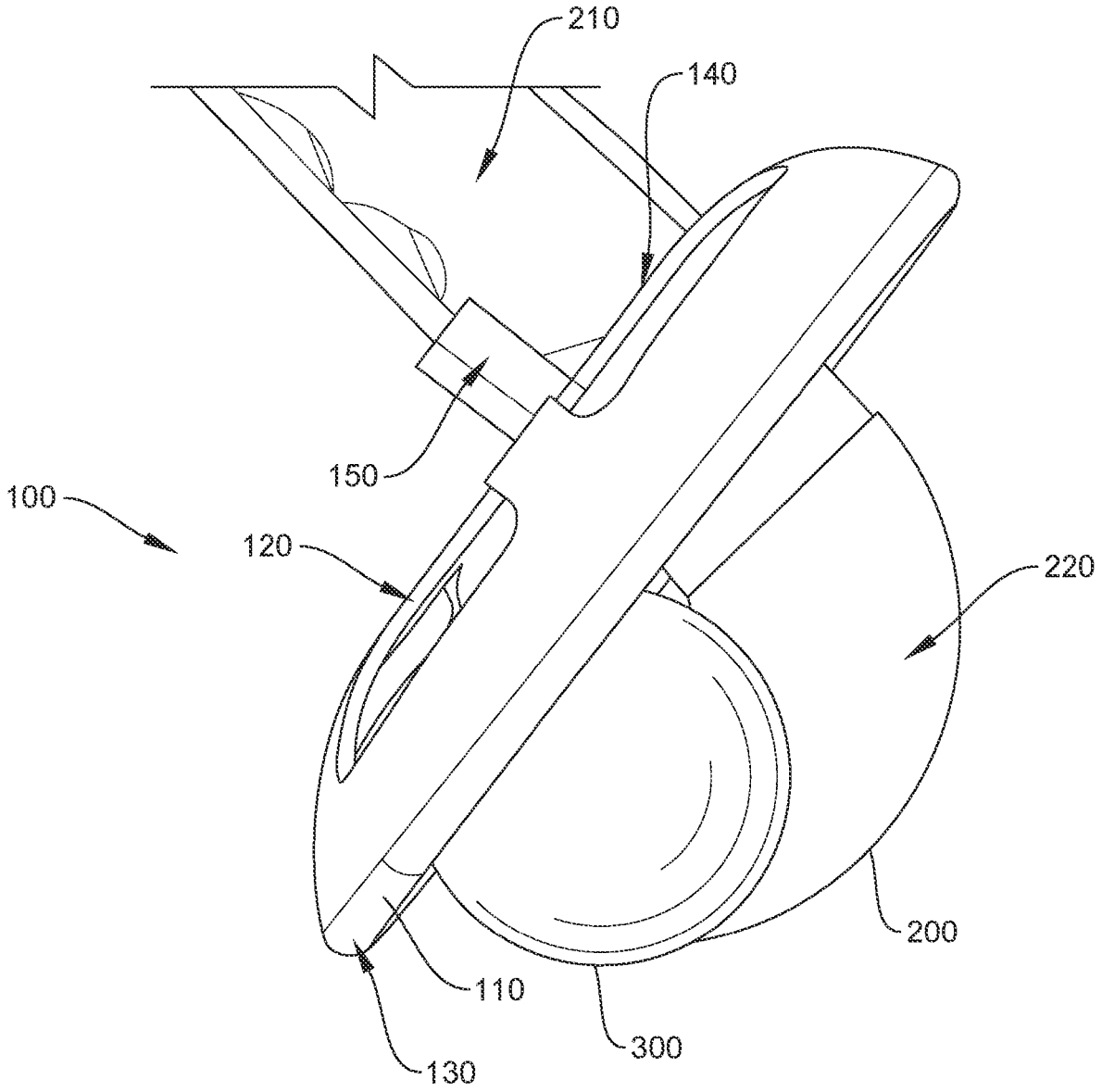
FIG. 3 shows another view of the training device, according to an exemplary embodiment of the present invention.

In one implementation, the training device mounted to the stick can control the motion of the stick handle during the player's movements of the stick and maintain the end of the stick in an optimal position of the ball during all movements. FIGS. 1-3 shows a few examples of the position of the training device for desired stick the ball positions. The training device can control and/or limit the range of motions of the stick during the repetitive motion. In other words, the number of variables can be reduced during different movements of the stick and the trainee can focus on limited variables. The repetitive motion can be executed by the trainee using the training device to move the ball. The repetitive motion of the stick guided by the training device trains the player's neuromuscular system to move the stick along or around the correct axis of motion. Movement of the stick along or around an incorrect axis can be prevented by the introduction of movement limiting mechanisms by the training device. The training device guides the movement of the stick along the correct axis of motion and rotations reducing the number of variables that the player has to manage with their hands. The reduction in the number of variables facilities a rapid learning process. The trainee can now focus on limited variables while the rest can be unconsciously learned by repetitive practice and the correct technique.

In one implementation, the training device can include sensors such as accelerator and gyroscope to track the movements of the training device for analysis. It is also envisioned to use a camera or a laser system to measure the distance that the ball travels left to right, the speed at which the ball travels, the number of repetitions, the percentage of time that the stick is in contact with the ball, the motion of the stick on the different axis, the contact between the stick and ball, the angle for the stick in relation to the ground and during the movement. All the information gathered from the sensors, cameras, or the laser system can be stored in an external memory which can be analyzed later using appropriate analytical techniques. The result of the analysis can be displayed on a screen or printed on a physical medium. The information and the analytical tools can be stored in a mobile phone or a server, including a cloud server, so that the trainee or concerned person such as a coach can access the information anytime and from anywhere. A dashboard can also be developed that displays the performance of the trainee and other statistical analyses of the training in graphical forms and can further show trends over time. Comparisons with the other trainees can also be made using the stored information.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A training device for a game of field hockey, the training device comprises:

a disc comprising a central section and a peripheral rim made of rigid lightweight material;

a sleeve defining an aperture in the central section configured to receive a handle, a shaft, and a head of a field hockey stick such that the shaft of the field hockey stick is perpendicular to the central section of the disc, the aperture being positioned offset from the center of the disc; and a fastening member coupled to the sleeve and configured to secure the disc of the training device to the head or the shaft of the field hockey stick such that the peripheral rim of the disc is in contact with the ground when at least some portion of the face of the stick, including the heel and toe, is simultaneously in contact with a ball, the aperture and peripheral rim of the disc configured such that when the stick is rotated about the end of the stick such that the face is moved to the opposite side of the ball the disc remains in contact with the ground for the entire rotation and the opposite end of the face is then in contact with the ground.

2. The training device according to claim 1, wherein the training device further comprises a camera or laser configured to detect changes selected from the group comprising tilt, position, movement, speed and rotation.

3. The training device according to claim 1, wherein the training device further comprises a plurality of sensors configured to detect tilt, change in position, and rotation of the training device.

4. The training device of claim 3, wherein the information is stored on external memory for further analysis.

5. The training device of claim 4, wherein the information is analyzed using appropriate analytical techniques and can be displayed on a screen.

6. The training device of claim 3, wherein the information and analysis is capable of being accessed remotely.

7. A hockey stick for a game of field hockey, the hockey stick has a handle, a shaft, a head, and a toe, wherein the hockey stick further comprises:

a training device mounted to the shaft or the head, the training device comprising:

a disc comprising a central section and a peripheral rim made of rigid lightweight material;

a sleeve defining an aperture in the central section attached to the shaft, such that the shaft of the stick is perpendicular to the central section of the disc the aperture and shaft being positioned offset from the center of the disc; and a fastening member coupled to the sleeve securing the disc of the training device to the shaft, such that the peripheral rim of the disc will be in contact with the ground when at least some portion of the face of the stick, including the heel and toe, is simultaneously in contact with a ball.

8. The hockey stick according to claim 7, wherein the aperture and peripheral rim of the disc are configured such that when the stick is rotated about the end of the stick such that the face is moved to the opposite side of the ball the disc remains in contact with the ground for the entire rotation and the opposite end of the face is then in contact with the ground.

9. The hockey stick according to claim 7, wherein the training device further comprises a camera or laser configured to detect changes selected from the group comprising tilt, position, movement, speed and rotation.

10. The hockey stick according to claim 7, wherein the training device further comprises a plurality of sensors configured to detect tilt, change in position, and rotation of the training device.

11. A method for learning dribbling skills in a game of stick and ball, the method comprising the steps of:

mounting a training device to a stick, wherein the training device comprises:

a disc comprising a central section and a peripheral rim made of rigid lightweight material, a sleeve defining an aperture in the central section configured to receive a handle and; a shaft of a stick such that the stick is perpendicular to the central section, the aperture being offset from the center of the disc, and a fastening member coupled to the sleeve and configured to secure the training device to the head or the shaft of the stick, wherein the training device is configured to guide a path of the stick in two or more axis of motion during dribbling of a ball by the stick such that the peripheral rim is kept on ground while a toe of the stick is on the ball.

12. The method according to claim 11, wherein the method further comprises the steps of:

adjusting a position of the training device on the shaft or the head of the stick such that the handle of the stick is within a desired angle range relative to a horizontal plane when the peripheral rim and the toe of the stick touches the ground.

13. The method according to claim 11, wherein the method further comprises the steps of:

positioning the training device while holding the stick at the handle in hands, such that the peripheral rim and the toe are on the ground; and dragging the ball by a face of the stick, while the peripheral rim and the toe remain on the ground.

14. The method according to claim 13, wherein the method further comprises the steps of:

rotating the handle of the stick such that the peripheral rim stays on the ground while the toe of the stick turns over the ball to land on an opposite side of the ball.

* * * * *